US005791857A

United States Patent [19]

Ziaylek, Jr. et al.

[11] Patent Number: 5,791,857

[45] Date of Patent: Aug. 11, 1998

[54] AUTOMATIC LADDER LOWERING AND STORAGE DEVICE FOR USE WITH AN EMERGENCY VEHICLE

[75] Inventors: Theodore Ziaylek, Jr., 140 Riverview Dr.; Michael Paul Ziaylek, 15 Cold Spring Ave., both of Yardley, Pa. 19067; Cielito B. Agoncillo, Newtown, Pa.

[73] Assignees: Theodore Ziaylek, Jr.; Michael Paul Ziaylek

[21] Appl. No.: 736,297

[22] Filed: Oct. 24, 1996

[51] Int. Cl.[6] ..... E06C 5/00

[52] U.S. Cl. ..... 414/462; 182/127

[58] Field of Search ..... 182/127; 224/548, 224/553; 414/462, 466, 680

[56] References Cited

U.S. PATENT DOCUMENTS

| | | | |
|---|---|---|---|
| D. 331,030 | 11/1992 | Ziaylek | D12/1 |
| 1,890,940 | 12/1932 | Fox . | |
| 2,586,531 | 2/1952 | Gordon . | |
| 2,946,397 | 7/1960 | Berberich . | |
| 3,013,681 | 12/1961 | Garnett . | |
| 3,058,607 | 10/1962 | Kiley . | |
| 3,112,041 | 11/1963 | Havens . | |
| 3,357,578 | 12/1967 | Koenig . | |
| 3,608,759 | 9/1971 | Spurgeon et al. . | |
| 3,700,123 | 10/1972 | Corley, Jr. . | |
| 3,703,968 | 11/1972 | Uhrich et al. . | |
| 3,715,044 | 2/1973 | Simons . | |
| 3,720,334 | 3/1973 | Permut et al. . | |
| 3,963,136 | 6/1976 | Spanke . | |
| 4,062,464 | 12/1977 | Grove . | |
| 4,170,331 | 10/1979 | Faulstich . | |
| 4,236,860 | 12/1980 | Gottlieb et al. | 414/462 |
| 4,239,438 | 12/1980 | Everson | 414/462 |
| 4,262,834 | 4/1981 | Nutt . | |
| 4,339,064 | 7/1982 | Ziaylek, Jr. . | |
| 4,376,611 | 3/1983 | Koop | 414/462 |
| 4,439,086 | 3/1984 | Thede | 414/462 |
| 4,751,981 | 6/1988 | Mitchell et al. | 182/127 |
| 4,808,056 | 2/1989 | Oshima | 414/462 |
| 4,826,387 | 5/1989 | Audet | 414/462 |
| 4,844,490 | 7/1989 | Kohler . | |
| 4,887,750 | 12/1989 | Dainty | 224/42.11 |
| 5,009,350 | 4/1991 | Schill et al. . | |
| 5,058,791 | 10/1991 | Henriquez et al. . | |
| 5,104,280 | 4/1992 | Ziaylek et al. | 414/462 |
| 5,154,563 | 10/1992 | Phillips | 414/462 |
| 5,209,628 | 5/1993 | Hassell | 414/462 |
| 5,297,912 | 3/1994 | Levi | 414/462 |
| 5,346,357 | 9/1994 | Hassell | 414/462 |
| 5,360,150 | 11/1994 | Praz . | |
| 5,421,495 | 6/1995 | Bubik et al. . | |
| 5,518,357 | 5/1996 | Ziaylek, Jr. et al. | 414/462 |

FOREIGN PATENT DOCUMENTS

| | | |
|---|---|---|
| 2622160 | 4/1989 | France . |

*Primary Examiner*—Janice L. Krizek
*Attorney, Agent, or Firm*—Sperry, Zoda & Kane

[57] ABSTRACT

A construction for use in storing of a ladder above an emergency vehicle during times of non-usage which is automatically movable to a retrieval position extending laterally outwardly from an emergency vehicle to facilitate removal of equipment therefrom such as a ladder. A boom is movable through an approximate 90 degree arc and when in the upright position is capable of being latched in place by a latching mechanism having a latching arm formed of a switching segment being capable of abutment with a limit switch and a locking segment adapted to engage a latching lug fixedly secured to the boom for retaining the apparatus in the upright position. The boom is operated by a primary hydraulic drive cylinder and the latching apparatus is driven by a secondary drive apparatus which includes an axially extensible coupling to facilitate latching of the boom in a storage position.

20 Claims, 4 Drawing Sheets

AUTOMATIC LADDER LOWERING AND STORAGE DEVICE FOR USE WITH AN EMERGENCY VEHICLE

BACKGROUND OF THE INVENTION

1. Field of the Invention

The present invention deals with the field of devices usable for conveniently and quickly making emergency equipment available to emergency personnel, such as firemen, while at the same time providing a means for storage of such equipment remotely on the emergency vehicle. Large emergency apparatus such as ladders present a difficulty in view of their cumbersome size and it is preferable to have storage thereof above the emergency vehicle if at all possible. The present invention provides a means for automatically moving a ladder or other large emergency equipment to the upright storage position and also in an automated fashion making such equipment movable to a retrieval position downwardly extending laterally from the equipment. The danger of holding of ladders in the upright position above vehicles is readily apparent especially with equipment designed to allow movement of the ladder from the upright position to a downward more readily available position. As such, the present invention deals with the field of art of devices for providing a locking mechanism to facilitate firm yet detachable securement of the emergency equipment and the bracket for mounting thereof in the stored position. Secured positioning in the storage position is especially important when mounted on such emergency vehicles since during motion of the vehicles substantial vibrations occur and failure of the latching mechanism for holding of the apparatus in the upright position can cause significant injury resulting from falling equipment and motor vehicle accidents. For this reason the present invention provides a unique automated lowering and storage device for a ladder for an emergency vehicle with a particularly improved latching mechanism for detachably securing the equipment in the stored position during times of non-usage thereof.

2. Description of the Prior Art

Numerous prior art devices have been utilized to facilitate the storage of equipment on emergency vehicles, and particulary, for the storage of ladders on emergency vehicles such as shown in U.S. Pat. No. 1,890,940 patented Dec. 13, 1932 to C. H. Fox and assigned to Ahrens-Fox Fire Engine Company on a "Fire Engine"; and U.S. Pat. No. 2,586,531 patented Feb. 19, 1952 to D. L. Gordon on a "Wheeled Support Having Ladder Assembly"; and U.S. Pat. No. 2,946,397 patented Jul. 26, 1960 to W. A. Berberich on a "Ladder Mount For Vehicles"; and U.S. Pat. No. 3,013,681 patented Dec. 19, 1961 to E. V. Garnett on a "Device For Storage Of Elongated Articles On A Vehicle"; and U.S. Pat. No. 3,058,607 patented Oct. 16, 1962 to J. T. Kiley and assigned to James A. Kiley Company on "Ladder Racks"; and U.S. Pat. No. 3,112,041 patented Nov. 26, 1963 to M. R. Havens on a "Compact Equipment Carrier"; and U.S. Pat. No. 3,357,578 patented Dec. 12, 1967 to J. O. Koenig on a "Boat Carrier For Pickup Mounted Camper Coaches"; and U.S. Pat. No. 3,608,759 patented Sep. 28, 1971 to L. A. Spurgeon et al and assigned to said Spurgeon on a "Car Top Carrier"; and U.S. Pat. No. 3,700,123 patented Oct. 24, 1972 to Q. D. Corley, Jr. on a "Power LIft And Gate Apparatus For Truck"; and U.S. Pat. No. 3,703,968 patented Nov. 28, 1972 to R. W. Uhrich et al and assigned to The United States of America as represented by the Secretary of the Navy on a "Linear Linkage Manipulator Arm"; and U.S. Pat. No. 3,715,044 patented Feb. 6, 1973 to G. Simons on a "Roof Mounted Carried For Automotive Vehicles"; and U.S. Pat. No. 3,720,334 patented Mar. 13, 1973 to A. Permut et al on "Boat And Equipment Loading Systems"; and U.S. Pat. No. 3,963,136 patented Jun. 15, 1976 to T. Spanke on a "Retractable Ladder Rack"; and U.S. Pat. No. 4,062,464 patented Dec. 13, 1977 to R. Grove on "Mounting Brackets For An Article Handling Apparatus"; and U.S. Pat. No. 4,170,331 patented Oct. 9, 1979 to E. Faulstich on a "Vehicle Ladder Rack"; and U.S. Pat. No. 4,236,860 patented Dec. 2, 1980 to D. Gottlieb et al on an "Apparatus For Lifting A Wheelchair Onto The Roof Of An Automobile"; and U.S. Pat. No. 4,239,438 patented Dec. 16, 1980 to C. Everson on a "Device For Lifting And Carrying Loads On Top Of Pickup Trucks"; and U.S. Pat. No. 4,262,834 patented Apr. 21, 1981 to W. Nutt and assigned to Teledyne Canada, Limited on a "Ladder Rack"; and U.S. Pat. No. 4,339,064 patented Jul. 13, 1982 to T. Ziaylek, Jr. on a "Carrier Clamp For Fire Ladders"; and U.S. Pat. No. 4,376,611 patented Mar. 15, 1983 to B. Koop on a "Car Top Carrier For Wheelchair"; and U.S. Pat. No. 4,439,086 patented Mar. 27, 1984 to R. Thede on a "Boat Loader"; and U.S. Pat. No. 4,751,981 patented Jun. 21, 1988 to J. Mitchell et al on a "Detachably Mounted Ladder Rack"; and U.S. Pat. No. 4,808,056 patented Feb. 28, 1989 to S. Oshima on an "Elevator Device Transportable In A Motor Vehicle"; and French Patent No. 2 622 160 patented Apr. 28, 1989 to G. Pobanz on a "Vehicle Roof Loader-Unloader-Has Guide Rails On Side Of Vehicle With Carriage And Cable-Winch System"; and U.S. Pat. No. 4,826,387 patented May 2, 1989 to M. Audet on a "Vehicle Roof Rack"; and U.S. Pat. No. 4,844,490 patented Jul. 4, 1989 to R. Kohler on a "Fire Truck Ladder Support"; and U.S. Pat. No. 4,887,750 patented Dec. 19, 1989 to R. Dainty and assigned to British Gas plc on a "Rack Arrangement"; and U.S. Pat. No. 5,009,350 patented Apr. 23, 1991 to J. Schill et al on "Retainer Assemblies For Elongated Objects"; and U.S. Pat. No. 5,058,791 patented Oct. 22, 1991 to K. Henriquez et al and assigned to Slide-Out, Inc. on a "Vehicular Ladder Rack"; and U.S. Pat. No. 5,104,280 patented Apr. 14, 1992 to M. P. Ziaylek et al and assigned to M. P. Ziaylek on an "Apparatus For Use With An Emergency Vehicle For Storage And Retrieval of Remotely Located Emergency Devices" and U.S. Pat. No. 5,154,563 patented Oct. 13, 1992 to J. R. Phillips on a "Wheel Chair Carrier"; and U.S. Design Pat. No. 331,030 patented Nov. 17, 1992 to M. Ziaylek et al and assigned to Michael P. Ziaylek on a "Unit For Use With An Emergency Vehicle For Storage And Retrieval Of Remotely Located Emergency Devices"; and U.S. Pat. No. 5,297,912 patented Mar. 29, 1994 to A. Levi and assigned to JAJ Products, Inc. on a "Ladder Rack For Motor Vehicles"; and U.S. Pat. No. 5,360,150 patented Nov. 1, 1994 to J. Praz on a "Roof Rack For Vehicles"; and U.S. Pat. No. 5,421,495 patented Jun. 6, 1995 to L. Bubik et al and assigned to Inovative Bicycle Design Inc. on a "Vehicle Roof Rack"; and U.S. Pat. No. 5,518,357 patented May 21, 1996 to T. Ziaylek, Jr. et al and assigned to Theodore Ziaylek, Jr. and Michael P. Ziaylek on a "Retaining And Retrieval Apparatus For Storage Of A Ladder Upon A Vehicle Shelf Area".

SUMMARY OF THE INVENTION

The present invention provides an automated ladder lowering and storage device which is particularly designed to be attachable with respect to the body of an emergency vehicle. A frame is included which is secured to the vehicle body and a boom means is pivotally secured to this frame and is movable through an arc of approximately 90 degrees between a generally upright storage position and a laterally extending retrieval position. In the retrieval position the boom provides ready access to a fireman standing on the ground to remove or replace emergency equipment such a ladder with respect to the boom.

A primary drive is included preferably including a reversible hydraulic cylinder pivotally secured to the frame and the boom and being axially extensible in such a manner as to urge movement of the boom between the retrieval position and the storage position. This primary drive is preferably operable to extend axially in such a manner as to urge movement of the boom from the retrieval position toward the storage position. In the opposite manner the primary drive is operable to retract axially to urge movement of the boom from the storage position toward the retrieval position.

A ladder retaining apparatus is included which is adapted to receive a ladder detachably secured thereon. This ladder retaining apparatus is preferably fixedly secured to the boom and is movable therewith to the retrieval position in such a manner as to facilitate removal and replacement of a ladder with respect thereto. It is movable with respect to the boom to a storage position for facilitating storage of a ladder attached thereto.

The ladder retaining apparatus may further include a ladder bracket member operable to detachably receive a ladder mounted thereon. Also a ladder clamping device may be resiliently attached to the ladder bracket member and extendable resiliently outwardly therefrom in such a manner as to be positioned over a ladder received by the ladder bracket member and in this manner resiliently retain this ladder adjacent the bracket.

A latching apparatus may also be included positioned between the frame and the boom for selective latching of the boom in the storage position securely and detachably. This latching apparatus may preferably include a latching arm pivotally mounted with respect to the frame. This latching arm is preferably movable between a latching position holding the boom locked in the storage position and an unlatching position which allows movement of the boom from a storage position toward the retrieval position. This latching arm preferably includes a locking tab member extending outwardly therefrom. The latching arm also is preferably of an L-shaped cross section to facilitate pivotal movement thereof and the latching operation. The latching arm preferably includes a locking segment and a switching segment which are integrally formed with respect to one another. A latching lug member is defined fixedly on the boom and is positioned extending outwardly therefrom approximately parallel with respect to the axis of pivotal rotation of the boom between the retrieval position and the storage position. This latching lug is engageable with respect to the locking segment of the latching arm in such a manner as to facilitate retaining of the latching arm means in the latching position with the boom in the storage position. This locking tab member is adapted to selectively interlock in abutment with respect to the latching lug in such a manner as to allow selective securement of the latching arm with respect to the latching lug and the boom in the storage position and the latching arm in the latching position. The latching lug also preferably includes an inclined abutment surface adapted to be forcibly moved into abutment with respect to the locking tab member in such a manner as to exert bias thereon as the boom means is moved from the retrieval position to the storage position.

A limit switch is also preferably included which is operatively connected with respect to the latching arm means and is positioned adjacent it. This limit switch is preferably operatively connected with respect to the primary drive in such a manner as to prevent axial retracting thereof responsive to the latching arm being in the latching position in order to prevent any movement of the boom from the storage position when latched in that position. The limit switch preferably is of a configuration such that it is normally open and is responsive to close only after actuation thereof caused by contact with the latching arm by movement thereof to the unlatched position to in this manner allow axial retracting of the primary drive and movement of the boom from the storage position.

The switching segment of the latching arm is also preferably adapted for selective abutment with the limit switch responsive to the latching arm being in the unlatching position. The limit switch preferably also includes a limit switch lever member adapted to be urged to move by the latching arm moving into abutment therewith responsive to movement thereof to the unlatched position. Movement of this limit switch lever member is adapted to cause actuation of the limit switch to allow movement of the boom toward the retrieval position.

The apparatus of the present invention further preferably includes a secondary drive pivotally attached with respect to the frame and pivotally attached with respect to the latching arm. This secondary drive is preferably movable between a secondary extended position urging movement of the latching arm to the unlatched position thereof and a secondary retracted position urging movement of the latching arm to the latching position thereof. The secondary drive means further includes an axially extensible coupling attached between the secondary drive and the latching arm. An inclined abutment surface is defined on the latching lug which is adapted to be forcibly urged into abutment with respect to the locking tab member as the boom is moved from the retrieval position to the storage position in such a manner as to urge the axially extensible coupling means to axially extend and allow pivotal movement of the latching arm from a latching position to the unlatching position to thereby allow latching of the latching lug means therewith. Said secondary drive also preferably includes an electric screw drive which includes an electrical actuator motor and a screw drive member in operative engagement with respect to one another.

The preferred configuration of the axial extensible coupling is to include a first coupling member attached to the latching arm and a second coupling member attached to the secondary drive and movably mounted with respect thereto. A resilient device such as a coil spring means may be positioned between the first and second coupling members in order to allow axial extension therebetween and yet to prevent axial compression therebetween.

It is an object of the present invention to provide an automated ladder lowering and storage device attachable to an emergency vehicle body wherein mounting within the conventional 14" lateral space provided on the emergency vehicles is made possible.

It is an object of the present invention to provide an automated ladder lowering and storage device attachable to an emergency vehicle body wherein initial capital outlay cost is minimized.

It is an object of the present invention to provide an automated ladder lowering and storage device attachable to an emergency vehicle body wherein maintenance requirements are minimized.

It is an object of the present invention to provide an automated ladder lowering and storage device attachable to an emergency vehicle body wherein the number of moving parts are minimized.

It is an object of the present invention to provide an automated ladder lowering and storage device attachable to an emergency vehicle body wherein down time is minimized.

It is an object of the present invention to provide an automated ladder lowering and storage device attachable to an emergency vehicle body wherein use with many different types of emergency equipment is made possible.

It is an object of the present invention to provide an automated ladder lowering and storage device attachable to an emergency vehicle body wherein use of many different types and sizes of ladders is made possible.

It is an object of the present invention to provide an automated ladder lowering and storage device attachable to an emergency vehicle body wherein quick and convenient movement from the storage position to the readily accessible retrieval position is made possible.

It is an object of the present invention to provide an automated ladder lowering and storage device attachable to an emergency vehicle body wherein a firm latching mechanism is provided for fixedly securing the boom in the upwardly extending storage position.

It is an object of the present invention to provide an automated ladder lowering and storage device attachable to an emergency vehicle body wherein easy detachment of the locking mechanism is provided in an automated fashion to allow quick movement of the ladder from the storage position to the retrieval position during emergency conditions often encountered by emergency equipment and personnel.

It is an object of the present invention to provide an automated ladder lowering and storage device attachable to an emergency vehicle body wherein ease of replacement of the ladder into the automated ladder storage equipment is significantly enhanced.

It is an object of the present invention to provide an automated ladder lowering and storage device attachable to an emergency vehicle body wherein no separate and distinct operation for unlocking of the ladder lowering device from the storage position is necessary due to the automated unlocking achieved by the specifically unique latching mechanism of the present invention.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
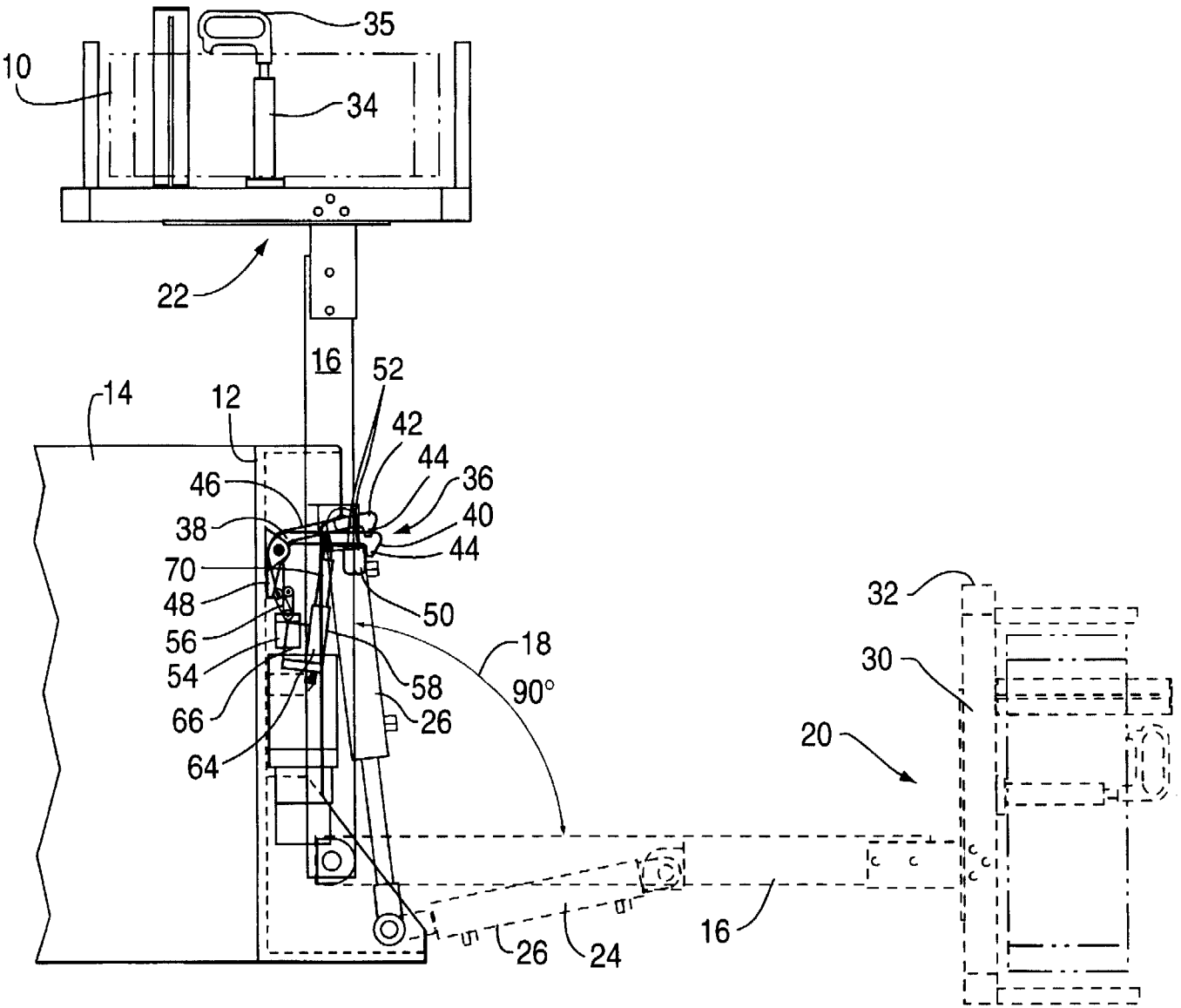
FIG. 1 is a side cross-sectional view of an embodiment of the automated ladder lowering and storage device of the present invention showing the boom positioned in the retrieval position as well as being located in the storage position.
Figure 2:
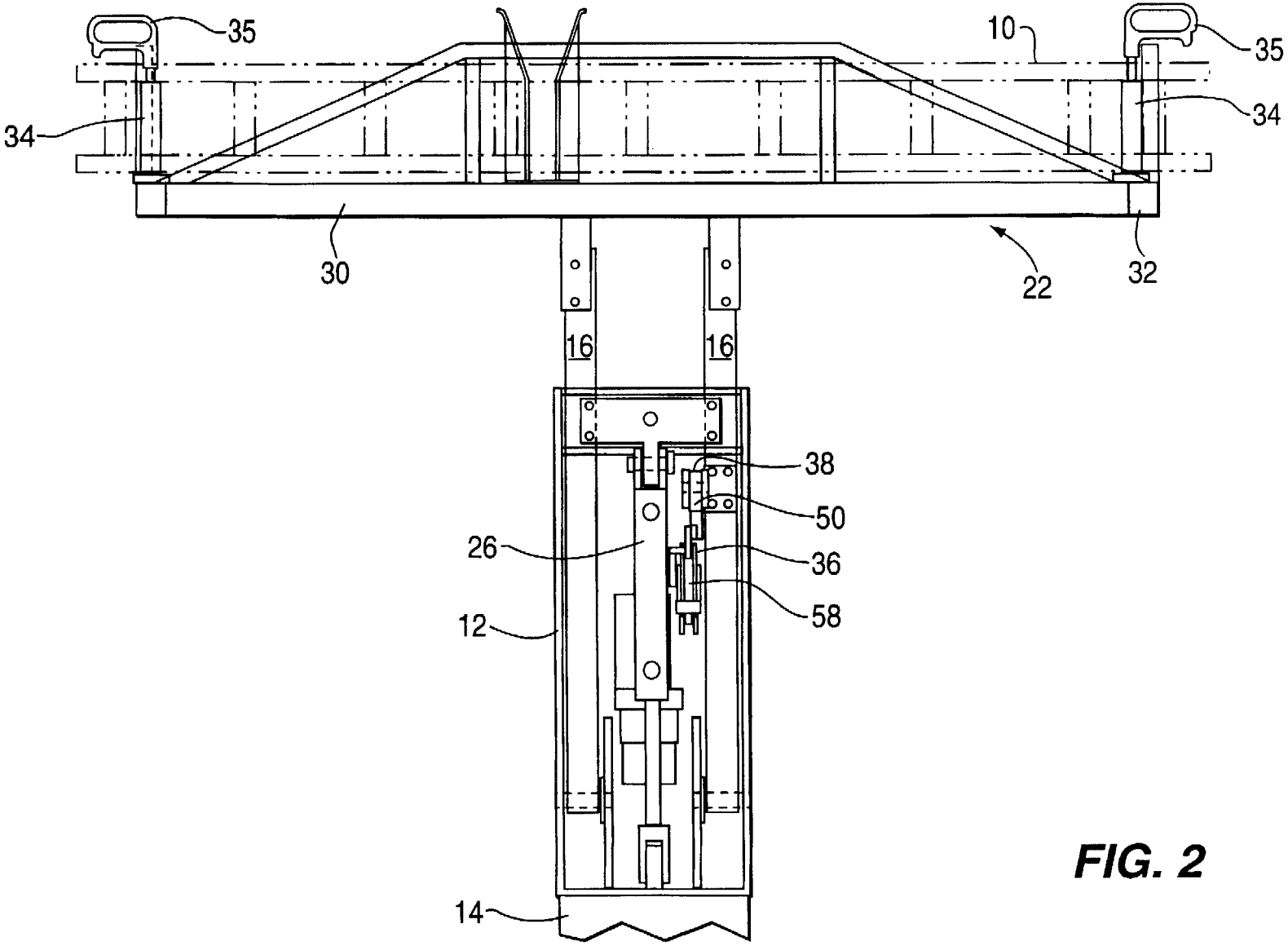
FIG. 2 is a front plan view of an embodiment of the apparatus of the present invention shown in the storage position.

The present invention provides an automated ladder lowering and storage device attachable to an emergency vehicle body 14. The ladder 10 is designed to be separable from the emergency vehicle 14 but is adapted to be detachably secured with respect to the storage apparatus disclosed in the present invention.

The device includes a frame 12 designed to be fixedly secured with respect to the emergency vehicle body 14 and preferably positioned within the conventional fourteen inch shelves commonly found on such vehicles. A boom 16 is mounted to the frame 12 and is pivotally movable with respect thereto through a movement arc 18 of approximately 90 degrees. This 90 degree arc will extend from an approximately vertically upward extending storage position 22 to a retrieval position 20 extending laterally from the emergency vehicle body 14. In the storage position 22 the boom 16 holding the ladder 10 will maintain the ladder in a position conveniently stored away from the other emergency equipment. Once the boom 16 is moved to the retrieval position 20 it will be easy for emergency personnel to remove the ladder from attachment with respect to the boom 16 since the retrieval position 20 extends laterally to a convenient location adjacent to the emergency vehicle body 14.

The apparatus of the present invention includes a primary drive 24 which preferably comprises a hydraulic cylinder 26 which may be reversible. This primary drive 24 is itself axially extensible to urge movement of the boom 16 between the retrieval position 20 and the storage position 22. In the preferred configuration the reversible hydraulic cylinder 26 will be capable of receiving hydraulic fluid through two conventional ports to achieve equal and opposite movement of the hydraulic cylinder 26 thereby allowing pivotal movement easily of the boom 16 between the retrieval position 20 and the storage position 22.

A ladder retaining bracket 30 is preferably secured to, in the preferred configuration, the outermost portion of the boom 16. This ladder retaining apparatus preferably includes a ladder bracket 32 which may be C-shaped in the preferred configuration to facilitate cradling or holding of a ladder secured thereto. It may also include ladder clamping devices 34 which are preferably flexibly resilient and include clamping handles 35 to facilitate extending thereof over ladders retained in position adjacent the ladder bracket 32 for securement with respect thereto.

Figure 4:
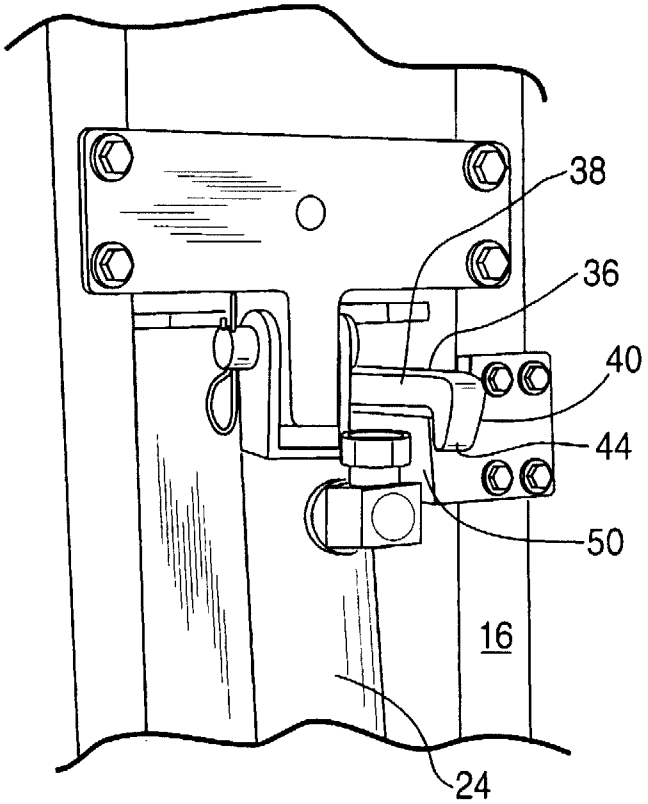
FIG. 4 is an illustration of the embodiment shown in FIG. 3 in the unlatching position.
Figure 3:
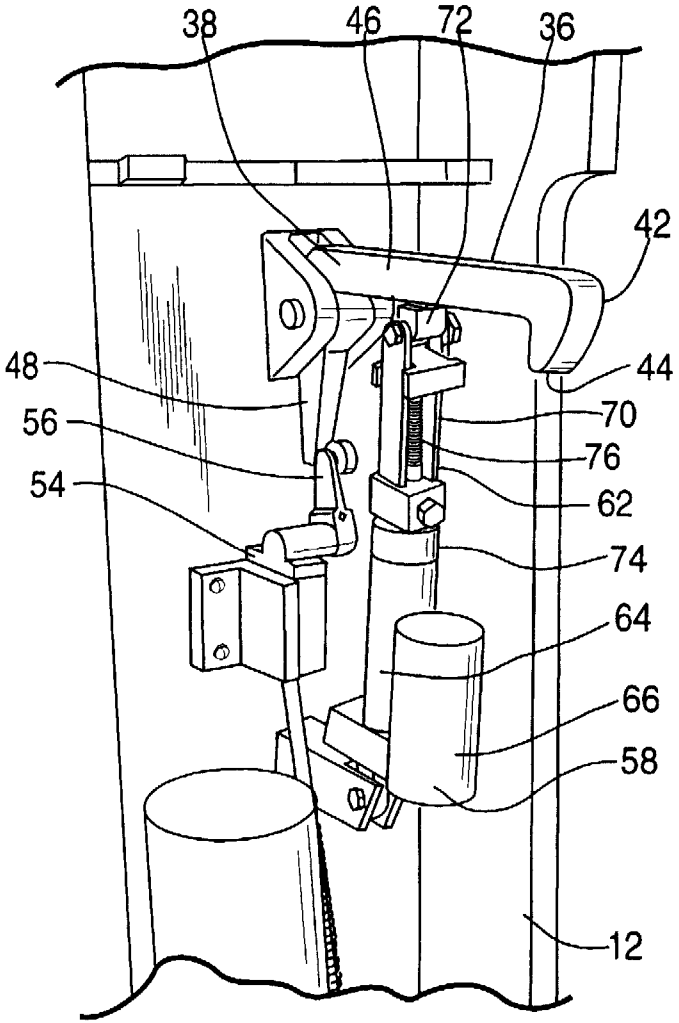
FIG. 3 is a side perspective view of an embodiment of the latching apparatus of the present invention shown in the latching position.
Figure 6:
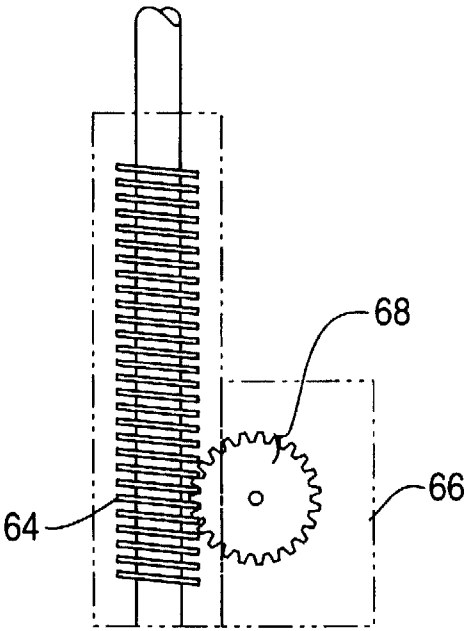
FIG. 6 is a side schematic illustration of the secondary drive of the present invention.
Figure 5:
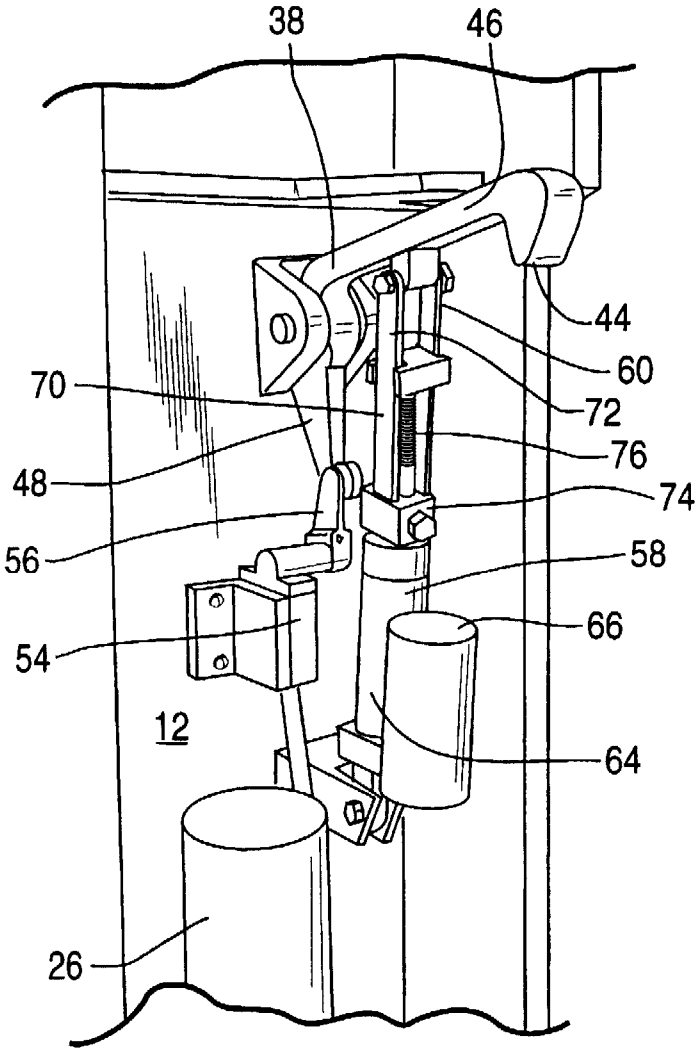
FIG. 5 is an illustration of the latching mechanism and boom apparatus of the present invention showing the latching apparatus in engagement with the boom detachably locked in the storage position.

The present invention further includes a latching apparatus 36 including a latching arm 38 which is preferably generally L-shaped. Latching arm 38 is designed to be movable between a latching position 40 as shown in FIGS. 3 and 4 and an unlatched position 42 as shown in FIG. 5.

In the latching position 40 the latching arm 38 will preferably include a locking tab member 44 which is designed to engage a latching lug 50 which is fixedly secured with respect to the boom 16. With the latching arm 38 and in particular the locking tab member 44 in engagement with the latching lug 50, the boom 16 can be detachably secured in the upwardly extending storage position 22.

The latching arm preferably includes two separate segments which form the general L-shape thereof. Firstly, a locking segment 46 will extend outwardly from the point of pivotal securement thereof with respect to the frame 12 in such a manner that the locking tab 44 can extend downwardly therefrom to facilitate engagement with respect to the latching lug 50. The latching arm 38 preferably will also include a switching segment 48 which is engageable with respect to a sensing or switching means for indicating whether the latching apparatus has moved completely to the unlatched position such that downward movement of the boom 16 is possible without causing binding or damage to the primary drive 24.

For this purpose a limit switch 54 is preferably positioned with a limit switch lever 56 adjacent the switching segment 48 of latching arm 38. Actuation of the limit switch 54 is caused by movement of the limit switch lever member 56 thereof. As can be seen in the figures herein, actuation of the limit switch 54 is only made possible once the latching arm 38 has moved completely to the unlatched position 42. Once movement to the completely unlatched position 42 is achieved then limit switch 54, which is operatively connected with respect to the primary drive 24, will be actuated thereby initiating downward movement of the boom 16 from the storage position 22 toward the retrieval position 20.

Movement of the latching apparatus 36 is partly controlled by a secondary drive 58. Preferably secondary drive 58 is axially extendable and is movable between a secondary extended position 60 as shown in FIG. 5 and a secondary retracted position 62 as shown in FIG. 3. Secondary drive 58 preferably includes an electric screw drive 64 which includes an electric actuation motor 66 and a screw drive member 68. Actuation of the electric motor 66 will cause movement of the screw drive member 68 operatively secured thereto and resultant driving of the electric screw drive 64. This will cause axial extension of the secondary drive 58 and upward movement of the locking segment 46 of latching arm 38. This upward movement will continue until the latching arm 38 has been rotated to such an extent that the locking tab member 44 thereof is no longer in engagement with respect to the latching lug 50 fixedly secured to the boom. Once the locking segment 46 of latching arm 38 has moved out of engagement with respect to the latching lug 50 the switching segment 48 of the latching arm 38 will actuate the limit switch 54 by abutting the limit switch lever member 56 thereof. Once limit switch 54 is closed full actuation of the primary hydraulic drive cylinder 24 will be made possible and downward movement of the boom 16 from the storage position 22 to the retrieval position 20 will be initiated. Once this downward movement terminates the electric actuation motor 66 will operate in a reverse manner causing axial retraction thereof and resulting in movement of the latching arm 38 to the latching position 40. At this point the ladder 10 can be removed from the ladder bracket 32 for use. Once the ladder 10 has been replaced and movement to the storage position 22 is again desired the primary hydraulic drive cylinder 24 will be operated in the opposite or reversed manner to cause axial extension thereof. This axial extension will cause upward movement of the boom 16 and of the ladder 10 mounted on the ladder bracket 32. Once the boom 16 has reached the point immediately adjacent to the storage position 22 where the latching lug 50 comes into abutment with the latching arm 38, final latching will be initiated.

This final latching is only made possible by allowing a way of movement of the latching arm 38 to the unlatching position 42 without requiring operation of the electric actuation motor 66. This mechanical movement is achieved by the inclusion of an axially extensible coupling 70 between the secondary drive 58 and the latching arm 38. This axially extensible coupling 70 preferably includes a first coupling member 72 preferably pivotally secured with respect to latching arm 38 and a second coupling member 74 preferably pivotally secured with respect to the secondary drive 58. The first and second coupling members are movably secured with respect to one another with a resilient means such as a coil spring means 76 mounted therebetween.

In operation for latching the latching lug 50 will preferably include an inclined abutment surface 52 thereon which is adapted to be brought into abutment with the locking tab member 44 of the latching arm 38 as it rests in position in the latching position 40. Further axial extension of the primary hydraulic drive cylinder 24 will cause a strong force to be exerted by the latching lug 50 and the inclined abutment surface 52 thereof against the locking tab member 44 and the latching arm 38. The locking segment 46 of the latching arm 38 will be urged to move upwardly resulting from axial extension of the axially extensible coupling 70. Once the latching lug 50 is cleared by the forced upward movement of the latching arm 38 the arm will snap downwardly around the lug 50 due to the pressure exerted thereon by the resilient coil spring means 76 of the coupling 70. At this point the boom 16 will have been moved to the full storage position 22 and be fully locked therein ready for unlimited storage until the next time when usage of the ladder contained thereon is required.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. An automated ladder lowering and storage device attachable to an emergency vehicle body comprising:

A. a frame means secured to an emergency vehicle body;

B. a boom means pivotally secured to said frame means and movable between a retrieval position extending generally laterally from said frame means and a storage position extending generally upwardly therefrom;

C. a primary drive means pivotally secured to said frame means and said boom means and being axially extensible to urge movement of said boom means between said retrieval position and said storage position, said primary drive means being operable to extend axially to urge movement of said boom means from said retrieval position toward said storage position and being operable to retract axially to urge movement of said boom means from said storage position toward said retrieval position;

D. a ladder retaining apparatus adapted to receive a ladder detachably secured thereto, said ladder retaining apparatus being fixedly secured to said boom means and movable therewith to said retrieval position to facilitate removal and replacement of a ladder with respect thereto and being movable with said boom means to said storage position for facilitating storage of a ladder attached thereto, said ladder retaining apparatus comprising:

(1) a ladder bracket member operable to detachably receive a ladder mounted with respect thereto;

(2) a ladder clamping means being resiliently attached to said ladder bracket member and extendable resiliently outwardly therefrom to extend over a ladder received by said ladder bracket member for resiliently retaining a ladder thereadjacent;

E. a latching apparatus positioned between said frame means and said boom means for selectively latching said boom means in the storage position securely and detachably, said latching apparatus comprising:

(1) a latching arm means pivotally mounted with respect to said frame means, said latching arm means being movable between a latching position holding said boom means locked in the storage position and an unlatching position allowing movement of said boom means from the storage position toward the retrieval position;

(2) a latching lug means fixedly secured to said boom means and extending outwardly therefrom, said latching lug means being engageable with said latching arm means to facilitate retaining of said latching arm means in the latching position with said boom means in the storage position;

(3) a limit switch means operatively connected with said latching arm means and positioned thereadjacent, said limit switch means being operatively connected to said primary drive means to prevent axial retracting thereof responsive to said latching arm means being in the latching position in order to prevent any movement of said boom means from said storage position when latched in that position; and (4) a secondary drive means pivotally attached with respect to said frame means and pivotally attached with respect to said latching arm means, said secondary drive means being movable between a secondary extended position urging movement of said latching arm means to the unlatching position thereof and a secondary retracted position urging movement of said latching arms means to the latching position thereof, said secondary drive means further including an axially extensible coupling means attached between said secondary drive means and said latching arm means.

2. An automated ladder lowering and storage device attachable to an emergency vehicle body as de fined in claim 1 wherein said latching arm means includes a locking tab member extending outwardly therefrom and adapted to selectively interlock in abutment with said latching lug means to facilitate selective securement of said latching arm means with respect to said latching lug means with said boom means in the storage position and said latching arm means in the latching position.

3. An automated ladder lowering and storage device attachable to an emergency vehicle body as defined in claim 2 wherein said latching lug means includes an inclined abutment surface adapted to be moved forcibly into abutment with respect said locking tab member as said boom means is moved from said retrieval position toward said storage position to urge said axially extensible coupling means to axially extend and allow pivotal movement of said latching arm means from the latching position to the unlatching position to allow latching of said latching lug means therewith.

4. An automated ladder lowering and storage device attachable to an emergency vehicle body as defined in claim 1 wherein said latching arm means is approximately L-shaped and includes a locking segment for selective securement with said latching lug means and a switching segment for selective abutment with said limit switch means responsive to said latching arm means being in the unlatching position.

5. An automated ladder lowering and storage device attachable to an emergency vehicle body as defined in claim 4 wherein said locking segment and said switching segment are integral with respect to one another to form said latching arm means.

6. An automated ladder lowering and storage device attachable to an emergency vehicle body as defined in claim 1 wherein said limit switch means is normally open and is responsive to close responsive to actuation thereof by contact thereof with said latching arm means by movement thereof to the unlatching position to allow axial retracting of said primary drive means and movement of said boom means from the storage position.

7. An automated ladder lowering and storage device attachable to an emergency vehicle body as defined in claim 1 wherein said limit switch means includes a limit switch lever member adapted to be urged to move by said latching arm means moving into abutment therewith responsive to movement thereof to the unlatching position, movement of said limit switch lever member adapted to cause actuation of said limit switch means to allow movement of said boom means toward the retrieval position.

8. An automated ladder lowering and storage device attachable to an emergency vehicle body as defined in claim 1 wherein said primary drive means is a hydraulic cylinder means.

9. An automated ladder lowering and storage device attachable to an emergency vehicle body as defined in claim 8 wherein said hydraulic cylinder means is reversible.

10. An automated ladder lowering and storage device attachable to an emergency vehicle body as defined in claim 1 wherein said secondary drive means is an electrical screw drive means.

11. An automated ladder lowering and storage device attachable to an emergency vehicle body as defined in claim 10 wherein said electrical screw drive means includes an electrical actuation motor means and a screw drive member in operative engagement with respect to one another.

12. An automated ladder lowering and storage device attachable to an emergency vehicle body as defined in claim 11 wherein said electrical actuation motor means includes an output gear means positioned in engagement with said screw drive member for driving thereof selectively to cause movement of said secondary drive means between the secondary extended position and the secondary retracted position.

13. An automated ladder lowering and storage device attachable to an emergency vehicle body as defined in claim 1 wherein said axially extensible coupling means comprises:

(1) a first coupling member attached to said latching arm means;

(2) a second coupling member attached to said secondary drive means and movably attached to said first coupling member; and (3) a resilient means positioned between said first coupling member and said second coupling member to allow axial extension therebetween and to prevent axial compression therebetween.

14. An automated ladder lowering and storage device attachable to an emergency vehicle body as defined in claim 13 wherein said resilient means comprises a coil spring means.

15. An automated ladder lowering and storage device attachable to an emergency vehicle body as defined in claim 1 wherein said boom means is movable through an arc of approximately 90 degrees between said retrieval position and said storage position thereof.

16. An automated ladder lowering and storage device attachable to an emergency vehicle body as defined in claim 1 wherein said ladder bracket member is generally C-shaped to facilitate receiving and retaining of a ladder therewithin.

17. An automated ladder lowering and storage device attachable to an emergency vehicle body as defined in claim 1 wherein said ladder clamping means include clamping handle means to facilitate clamping of a ladder in position adjacent said ladder bracket member.

18. An automated ladder lowering and storage device attachable to an emergency vehicle body as defined in claim 1 wherein said latching lug means extends outwardly from said boom means in a direction approximately parallel to the axis of pivotal movement of said boom means.

19. An automated ladder lowering and storage device attachable to an emergency vehicle body comprising:

A. a frame means secured to an emergency vehicle body;

B. a boom means pivotally secured to said frame means and movable through an arc of approximately ninety degrees between a retrieval position extending generally laterally from said frame means and a storage position extending generally upwardly therefrom;

C. a primary drive means pivotally secured to said frame means and said boom means and being axially extensible to urge movement of said boom means between said retrieval position and said storage position, said primary drive means being operable to extend axially to urge movement of said boom means from said retrieval position toward said storage position and being operable to retract axially to urge movement of said boom means from said storage position toward said retrieval position;

D. a ladder retaining apparatus adapted to receive a ladder detachably secured thereto, said ladder retaining apparatus being fixedly secured to said boom means and movable therewith to said retrieval position to facilitate removal and replacement of a ladder with respect thereto and being movable with said boom means to said storage position for facilitating storage of a ladder attached thereto, said ladder retaining apparatus comprising:

(1) a ladder bracket member operable to detachably receive a ladder mounted with respect thereto;

(2) a ladder clamping means being resiliently attached to said ladder bracket member and extendable resiliently outwardly therefrom to extend over a ladder received by said ladder bracket member for resiliently retaining a ladder thereadjacent;

E. a latching apparatus positioned between said frame means and said boom means for selectively latching said boom means in the storage position securely and detachably, said latching apparatus comprising;

(1) a latching arm means pivotally mounted with respect to said frame means, said latching arm means being movable between a latching position holding said boom means locked in the storage position and an unlatching position allowing movement of said boom means from the storage position toward the retrieval position, said latching arm means including a locking tab member extending outwardly therefrom;

(2) a latching lug means fixedly secured to said boom means and extending outwardly therefrom, said latching lug means being engageable with said latching arm means to facilitate retaining of said latching arm means in the latching position with said boom means in the storage position, said locking tab member adapted to selectively interlock in abutment with said latching lug means to facilitate selective securement of said latching arm means with respect to said latching lug means with said boom means in the storage position and said latching arm means in the latching position, said latching lug means including an inclined abutment surface adapted to be forcibly moved into abutment with respect to said locking tab member to exert bias thereupon as said boom means is moved from said storage position toward said retrieval position;

(3) a limit switch means operatively connected with said latching arm means and positioned thereadjacent, said limit switch means being operatively connected to said primary drive means to prevent axial retracting thereof responsive to said latching arm means being in the latching position in order to prevent any movement of said boom means from said storage position when latched in that position, said limit switch means being normally open and is responsive to close responsive to actuation thereof by contact thereof with said latching arm means by movement thereof to the unlatching position to allow axial retracting of said primary drive means and movement of said boom means from the storage position;

(4) a secondary drive means pivotally attached with respect to said frame means and pivotally attached with respect to said latching arm means, said secondary drive means being movable between a secondary extended position urging movement of said latching arm means to the unlatching position thereof and a secondary retracted position urging movement of said latching arms means to the latching position thereof, said secondary drive means further including an axially extensible coupling means attached between said secondary drive means and said latching arm means, said inclined abutment surface of said latching lug means adapted to be forcibly urged into abutment with respect to said locking tab member as said boom means is moved from said retrieval position toward said storage position to urge said axially extensible coupling means to axially extend and allow pivotal movement of said latching arm means from the latching position to the unlatching position to allow latching of said latching lug means therewith, said secondary drive means including an electrical screw drive means, said axially extensible coupling means further comprising:

(a) a first coupling member pivotally secured to said secondary drive means;

(b) a second coupling member pivotally secured to said secondary drive means; and (c) a resilient means positioned between said first coupling member and said second coupling member to allow axial extension therebetween and of said axially extensible coupling means and prevent axial compression therebetween.

20. An automated ladder lowering and storage device attachable to an emergency vehicle body comprising:

A. a frame means secured to an emergency vehicle body;

B. a boom means pivotally secured to said frame means and movable through an arc of approximately ninety degrees between a retrieval position extending generally laterally outwardly from said frame means and a storage position extending generally upwardly therefrom;

C. a primary drive means comprising a reversible hydraulic cylinder means pivotally secured to said frame means and said boom means and being axially extensible to urge movement of said boom means between said retrieval position and said storage position, said primary drive means being operable to extend axially to urge movement of said boom means from said retrieval position toward said storage position and being operable to retract axially to urge movement of said boom means from said storage position toward said retrieval position;

D. a ladder retaining apparatus adapted to receive a ladder detachably secured thereto, said ladder retaining apparatus being fixedly secured to said boom means and movable therewith to said retrieval position to facilitate removal and replacement of a ladder with respect thereto and being movable with said boom means to said storage position for facilitating storage of a ladder attached thereto, said ladder retaining apparatus comprising:

(1) a ladder bracket member operable to detachably receive a ladder mounted with respect thereto;

(2) a ladder clamping means being resiliently attached to said ladder bracket member and extendable resiliently outwardly therefrom to extend over a ladder received by said ladder bracket member for resiliently retaining a ladder thereadjacent;

E. a latching apparatus positioned between said frame means and said boom means for selectively latching said boom means in the storage position securely and detachably, said latching apparatus comprising;

(1) a latching arm means pivotally mounted with respect to said frame means, said latching arm means being movable between a latching position holding said boom means locked in the storage position and an unlatching position allowing movement of said boom means from the storage position toward the retrieval position, said latching arm means including a locking tab member extending outwardly therefrom, said latching arm means being approximately L-shaped and including:

(a) a locking segment;

(b) a switching segment integrally formed with said locking segment;

(2) a latching lug means fixedly secured to said boom means and extending outwardly therefrom approximately parallel with respect to the axis of pivotal rotation of said boom means between said retrieval position and said storage position, said latching lug means being engageable with said locking segment of said latching arm means to facilitate retaining of said latching arm means in the latching position with said boom means in the storage position, said locking tab member adapted to selectively interlock in abutment with said latching lug means to facilitate selective securement of said latching arm means with respect to said latching lug means with said boom means in the storage position and said latching arm means in the latching position, said latching lug means including an inclined abutment surface adapted to be forcibly movable into abutment with respect to said locking tab member to exert bias thereupon as said boom means is moved from said retrieval position toward said storage position;

(3) a limit switch means operatively connected with said latching arm means and positioned thereadjacent, said limit switch means being operatively connected to said primary drive means to prevent axial retracting thereof responsive to said latching arm means being in the latching position in order to prevent any movement of said boom means from said storage position when latched in that position, said limit switch means being normally open and being responsive to close responsive to actuation thereof by contact thereof with said latching arm means by movement thereof to the unlatching position to allow axial retracting of said primary drive means and movement of said boom means from the storage position, said switching segment of said latching arm means being adapted for selective abutment with said limit switch means responsive t o said latching arm means being in the unlatching position, said limit switch means including a limit switch lever member adapted to be urged to move by said latching arm means moving into abutment therewith responsive to movement thereof to the unlatching position, movement of said limit switch lever member adapted to cause actuation of said limit switch means to allow movement of said boom means toward the retrieval position;

(4) a secondary drive means pivotally attached with respect to said frame means and pivotally attached with respect to said latching arm means, said secondary drive means being movable between a secondary extended position urging movement of said latching arm means to the unlatching position thereof and a secondary retracted position urging movement of said latching arms means to the latching position thereof, said secondary drive means further including an axially extensible coupling means attached between said secondary drive means and said latching arm means, said inclined abutment surface of said latching lug means adapted to be forcibly urged into abutment with respect to said locking tab member as said boom means is moved from said retrieval position toward said storage position to urge said axially extensible coupling means to axially extend and allow pivotal movement of said latching arm means from the latching position to the unlatching position to allow latching of said latching lug means therewith, said secondary drive means including an electrical screw drive means, said electrical screw drive means including an electrical actuation motor means and a screw drive member in operative engagement with respect to one another, said axially extensible coupling means further comprising:

(a) a first coupling member attached to said latching arm means;

(b) a second coupling member attached to said secondary drive means and movably attached to said first coupling member; and (c) a resilient means comprising a coil spring means positioned between said first coupling member and said second coupling member to allow axial extension therebetween and to prevent axial compression therebetween.

* * * * *